US005211596A

United States Patent [19]

Bradshaw

[11] Patent Number: 5,211,596

[45] Date of Patent: May 18, 1993

[54] AIR ACTIVATED AMUSEMENT DEVICE

[76] Inventor: Franklin F. Bradshaw, 927 42 St., Brooklyn, N.Y. 11219

[21] Appl. No.: 833,100

[22] Filed: Feb. 10, 1992

[51] Int. Cl.[5] ..... A63H 29/16

[52] U.S. Cl. ..... 446/202; 273/457; 446/179

[58] Field of Search ..... 273/457; 446/179, 200, 446/202

[56] References Cited

U.S. PATENT DOCUMENTS

| | | | |
|---|---|---|---|
| 612,622 | 10/1898 | Windrath | 446/202 |
| 2,118,609 | 5/1938 | Klug | 446/179 |
| 2,611,994 | 9/1952 | Dailey | 446/202 |
| 2,924,459 | 2/1960 | Bryant | 446/179 X |
| 3,087,278 | 4/1963 | Waggle, Jr. | 446/202 |
| 4,527,351 | 7/1985 | Gerakiteys | 446/202 |

*Primary Examiner*—William H. Grieb
*Attorney, Agent, or Firm*—Goodman & Teitelbaum

[57] ABSTRACT

An air activated amusement device having a hollow body member including a cylindrical side wall, and a front wall and a rear wall at opposite sides thereof, with an elongated tubular member connected to the rear wall, and a ball disposed against the front wall. The user blows into the tubular member so that air is transferred from the tubular member through the body member to an outer surface of the ball, where the air causes the ball to rotate against the front wall without falling away when the front wall is in a vertical position. Preferably, the front wall has a concave wall portion matching the outer surface of the ball so that a portion of the ball is received in the concave wall portion to allow the ball to be freely rotatable against an outer surface of the concave wall portion. Openings are provided in the front wall to permit air to enter the body member, with a hole being provided in the side wall of the body member to permit air to exit from the body member, and a further hole is provided in the rear wall to permit additional air to enter the body member, where the hole in the side wall is larger than the hole in the rear wall.

17 Claims, 1 Drawing Sheet

AIR ACTIVATED AMUSEMENT DEVICE

BACKGROUND OF THE INVENTION

The invention relates to an amusement device and, more particularly, to an air activated amusement device for rotating a ball in a suspended arrangement.

Air activated amusement devices are well known in the prior art. A pea-shooter is an example of a prior art device, where peas, balls and the like are blown out of a straw-like member towards a target. A bubble pipe is another example of such a device, where there are numerous other types of air activated amusement devices.

The amusement device of the present invention can also be used as a therapeutic device to increase the user's breath capacity, such as for people suffering from asthma. Furthermore, hospitals normally provide their patients with therapeutic devices to increase their breath capacity and to clear their lungs after certain types of surgery, where such devices include light weighted balls disposed in a transparent clear plastic container having a tube connected thereto into which the patient can blow in order to suspend the light weighted balls for predetermined periods of time.

Therefore, there is presently a need for an air activated amusement device which can provide the user with periods of enjoyment, and which can also be used as a therapeutic device to increase the user's breath capacity.

SUMMARY OF THE INVENTION

It is accordingly an object of the present invention to provide an air activated amusement device which avoids the problems and disadvantages of the prior art devices.

Another object of the present invention is to provide an air activated amusement device which functions to rotate a ball suspended from an end of the device.

A further object of the present invention is to provide an air activated amusement device which includes a bendable tubular member into which the user can blow in order to rotate the ball.

Still another object of the present invention is to provide an air activated amusement device as mentioned above which includes a body member having an end wall provided with a concave wall portion matching an outer surface of the ball so that a portion of the ball is received therein to facilitate the rotating of the ball.

Yet another object of the present invention is to provide an air activated amusement device as described above which is inexpensive to manufacture, has a few parts, and which can be easily used as both an amusement device and as a therapeutic device.

Briefly, in accordance with the present invention, there is provided an air activated amusement device having a hollow body member including a cylindrical side wall, and a front wall and a rear wall at opposite sides thereof, with an elongated tubular member connected to the rear wall, and a ball disposed against the front wall, so that when the user blows into the tubular member, the air is transferred from the tubular member through the body member to an outer surface of the ball, where the air causes the ball to rotate against the front wall without falling away from the front wall when the front wall is in a vertical position. Preferably, the front wall has a concave wall portion, matching the outer surface of the ball so that a portion of the ball is received in the concave wall portion and the ball is freely rotatable against an outer surface of the concave wall portion. Openings are provided in the front wall to permit air to enter the body member, with a hole being provided in the side wall of the body member to permit air to exit from the body member, and a further hole is provided in the rear wall to permit additional air to enter the body member, where the hole in the side wall is larger than the hole in the rear wall.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
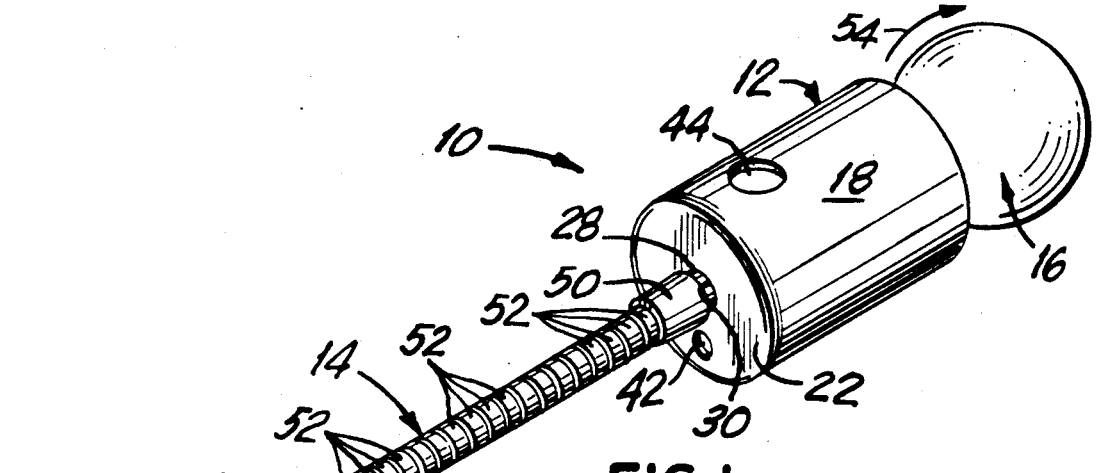
FIG. 1 is a perspective view of an air activated amusement device according to the present invention.
Figure 2:
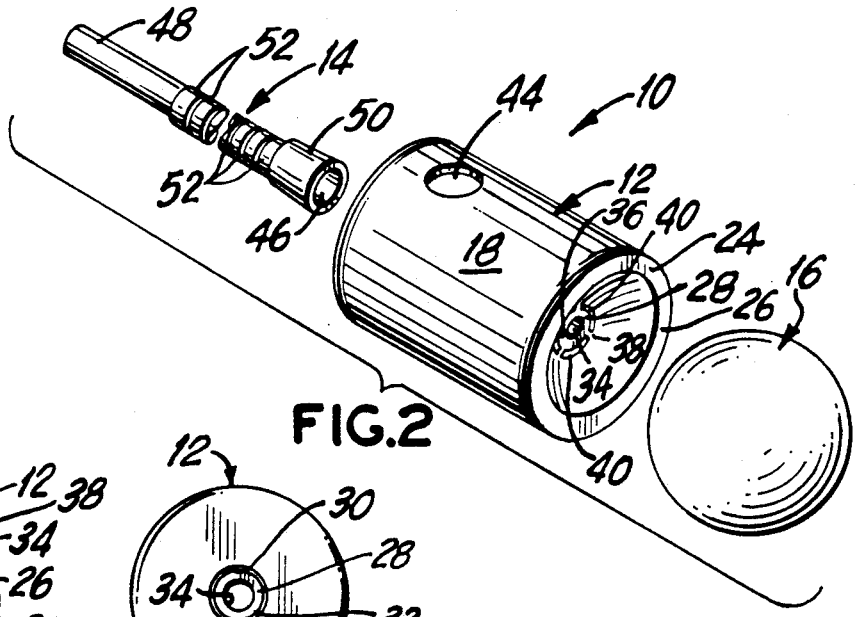
FIG. 2 is a perspective fragmented exploded view of the device of FIG. 1.

Referring now to the drawings, FIG. 1 shows an air activated amusement device 10 according to the present invention. The amusement device 10 comprises three separable parts as shown in FIG. 2, including a body member 12, an elongated tubular member 14 and a ball 16.

Figure 5:
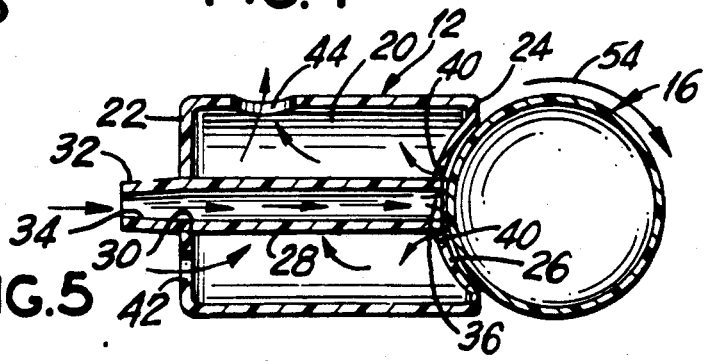
FIG. 5 is a cross sectional view of the body member and hollow ball of the device.

The body member 12 has a cylindrical outer side wall 18 and is hollow to provide an interior space 20 therein as shown in FIG. 5. The body member 12 has a circular rear end wall 22 and a circular front end wall 24 provided with a centrally located concave wall portion 26 therein so that the interior space 20 is enclosed by the side wall 18, the rear end wall 22 and the front end wall 24. The function of the concave wall portion 26 will be explained below.

As best shown in FIG. 5, a tube 28 extends longitudinally through the hollow body member 12 from a central portion of the concave wall portion 26 and through an opening 30 in the rear end wall 22 so that the rear end portion 32 of the tube 28 projects outwardly from the body member 12. The rear end portion 32 of the tube 28 is tapered inwardly towards the rear end of the tube 28, the function of which will be explained below. The tube 28 has a longitudinally extending opening 34 therethrough.

Figure 3:
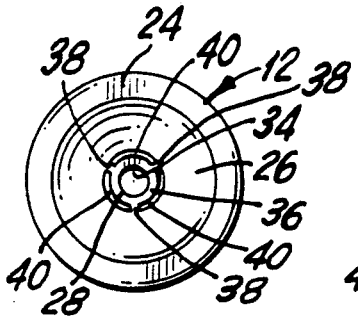
FIG. 3 is a front elevational view of the body member of the device shown in FIG. 1.

As shown in FIG. 3, the front end 36 of the tube 28 is secured to the concave wall portion 26 of the body member 12 by spaced apart web portions 38 to provide spaced apart openings or slots 40 through the concave wall portion 26 around the front end 36 of the tube 28. Preferably, there are three web portions 38 to provide three slots 40, where the function of the slots 40 will be explained below.

Figure 4:
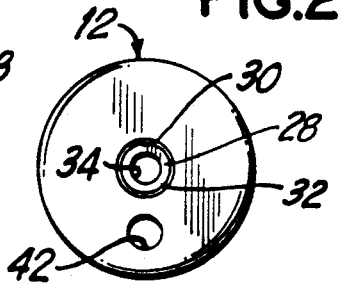
FIG. 4 is a rear elevational view of the body member of FIG. 3.

As shown in FIGS. 4 and 5, the rear end portion 32 of the tube 28 is secured by suitable conventional means within the opening 30 of the rear end wall 22 of the body member 12, such as by cement, glue, adhesive, etc. Additionally, a small off-center hole 42 is provided through the rear end wall 22, and a larger hole 44 is provided in the side wall 18 adjacent to the rear end wall 22, where the functions of the holes 42, 44 will be explained below. Preferably, the body member 12 and the tube 28 are fabricated from a suitable rigid plastic material.

As shown in FIGS. 1 and 2, the tubular member 14 resembles a straw and has an opening 46 extending longitudinally therethrough. Preferably, the outer surface of the rear end portion 48 is smooth so that the user can comfortably place the rear end portion 48 in his or her mouth, as set forth below. The opposite front end portion 50 is enlarged and is tapered outwardly towards the front end thereof, where the walls of the opening 46 in the front end portion 50 is also tapered to match the taper on the rear end portion 32 of the tube 28 so that the opening 46 in the front end portion 50 can matingly receive, in a force fit engagement, the rear end portion 32 of the tube 28 therein, as set forth below.

Preferably, the elongated tubular member 14 is fabricated from a suitable flexible plastic material to permit the bending of the elongated tubular member 14. Additionally, a plurality of spaced apart grooves 52 are provided transversely around the elongated tubular member 14 to facilitate the bending of the elongated tubular member 14, as explained below.

As best shown in FIG. 5, the ball 16 is hollow to reduce the weight thereof, where the ball 16 resembles a Ping Pong ball. Preferably, the ball 16 is fabricated from a suitable rigid plastic material. As indicated in FIG. 5, the outer wall surface of the ball 16 matches the outer surface of the concave wall portion 26 of the body member 12 so that a portion of the ball 16 can be received in the concave wall portion 26, and the ball 16 can freely rotate against the outer surface of the concave wall portion 26, as explained below.

Accordingly, in use, the enlarged front end portion 50 of the tubular member 14 is first pushed onto the rear end portion 32 of the tube 28 of the body member 12 so that the opening 46 in the front end portion 50 receives the rear end portion 32 of the tube 28 therein in a force fit engagement to secure the tubular member 14 to the body member 12. The user then holds the body member 12 by placing the body member 12 between his or her thumb and one or two fingers. Then, the ball 16 is placed against the concave wall portion 26 and held loosely in place by another one of the user's fingers. The rear end portion 48 of the tubular member 14 is now placed in the user's mouth, and the user blows into the tubular member 14, while holding the body member 12 and the elongated tubular member 14 in a horizontal position extending outwardly from the user's mouth.

As the user continues to blow into the tubular member 14, the ball 16 will start to rotate as indicated by the arrow 54 in FIGS. 1 and 5. Once the ball 16 is rotating, the user can remove his or her finger from the ball 16, where the ball 16 when free from the user's finger will continue to rotate and will not fall, even though the concave wall portion 26 is in a vertical position. The user tries to keep the ball 16 rotating as long as possible, which usually depends upon the user's breath capacity, where continuous use of the amusement device 10 can increase the user's breath capacity. An explanation of why the ball 16 continues to rotate without falling is set forth below.

It is noted, that when the user first attempts to use the amusement device 10, it may be difficult to continuously rotate the ball 16 without the ball 16 falling. Accordingly, it is suggested that when the user places the rear end portion 48 of the tubular member 14 in his or her mouth, the user bends the tubular member 14 upwardly so that the body member 12 is in a vertical portion with the ball 16 resting on top of the concave wall portion 26 of the body member 12. The user would now blow into the tubular member 14, and as the ball 16 starts to rotate, the user would then bend the tubular portion 14 back down so that the body member is now again in the horizontal position, where the ball 16 will now continue to rotate and will not fall. Once the user has gained experience, the user can start with the body member in the horizontal position as mentioned above.

When the user blows into the tubular member 14, the air flows from the tubular member 14 into the tube 28 of the body member 12, and then flows out of the tube 28 against the outer surface of the ball 16. When the air hits the surface of the ball 16, the air is forced back through the slots 40 into the interior space 20 of the body member 12, as shown in FIG. 5. The air then exits the interior space 20 through the closer larger hole 44 in the side wall 18 of the body member 12, rather than exiting through the smaller hole 42 in the rear end wall 22 because of the closeness and larger size of the larger hole 44, where additional air is brought into the interior space 20 through the smaller hole 42 in the rear end wall 22.

Accordingly, the flow of air exiting from the tube 28 and entering into the slots 40 in the concave wall portion 26, is forced against the surface of the ball 16 thus causing the ball 16 to rotate. Furthermore, this air flowing against the surface of the ball 16 reduces the pressure between the ball 16 and the concave wall portion 26 so that when the user's finger is removed from the ball 16, the ball 16 will not fall due to the fact that the atmospheric pressure on the opposite side of the ball 16 is higher than the pressure between the ball 16 and the concave wall portion 26, thereby maintaining the ball 16 in its position within the concave wall portion 26.

Numerous alterations of the structure herein disclosed will suggest themselves to those skilled in the art. However, it is to be understood that the present disclosure relates to a preferred embodiment of the invention which is for the purpose of illustration only, and it is not to be construed as a limitation of the invention.

What is claimed is:

1. An amusement device comprising:

a body member having a front wall and an opposite rear wall, said body member being hollow to receive air therein;

an elongated tubular member connected to said rear wall;

a ball disposed against said front wall;

said body member having tube means for transferring air from said tubular member to an outer surface of said ball so that the air from the tube means causes said ball to rotate against said front wall without falling away from said front wall when said front wall is in a vertical position;

said tube means including a tube extending through said body member and secured to both said front and rear walls;

opening means being provided in said front wall around said tube to permit air to enter said body member; and one opening being provided in said body member to permit air to exit from said body member.

2. An amusement device according to claim 1, wherein said front wall has a concave wall portion matching said outer surface of said ball so that a portion of said ball is received in said concave wall portion and said ball is freely rotatable against an outer surface of said concave wall portion.

3. An amusement device according to claim 1, wherein a rear portion of said tube projects outwardly from said rear wall to receive said tubular member thereon.

4. An amusement device according to claim 3, wherein said rear portion of said tube is tapered, and a front portion of said tubular member is tapered to matingly receive said tapered rear portion of said tube therein in a force fit engagement to removably secure said tubular member to said body member.

5. An amusement device according to claim 1, wherein said front wall has a concave wall portion matching said outer surface of said ball so that a portion of said ball is received in said concave wall portion and said ball is freely rotatable against an outer surface of said concave wall portion, said tube being secured to said concave wall portion and said opening means being provided in said concave wall portion for association with said ball.

6. An amusement device according to claim 1, wherein a second opening is provided in said rear wall to permit additional air to enter said body member.

7. An amusement device according to claim 6, wherein said body member has a cylindrical outer side wall with said front and rear walls being at opposite ends of said side wall.

8. An amusement device according to claim 7, wherein said one opening is provided in said side wall.

9. An amusement device according to claim 8, wherein said one opening is larger than said second opening.

10. An amusement device according to claim 1, wherein said ball is hollow to reduce its weight.

11. An amusement device according to claim 10, wherein said ball is fabricated from a plastic material.

12. An amusement device according to claim 1, wherein said tubular member is fabricated from a bendable plastic material.

13. An amusement device according to claim 12, wherein a plurality of spaced apart grooves are provided transversely around said tubular member to facilitate the bending thereof.

14. An amusement device according to claim 1, wherein said body member has a cylindrical outer side wall with said front and rear walls being at opposite ends of said side wall.

15. An amusement device according to claim 14, wherein said front wall has a concave wall portion matching said outer surface of said ball so that a portion of said ball is received in said concave wall portion and said ball is freely rotatable against an outer surface of said concave wall portion.

16. An amusement device according to claim 15, wherein said body member is fabricated from a plastic material.

17. An amusement device according to claim 1, wherein said body member is fabricated from a plastic material.

* * * * *